United States Patent [19]

Fisher et al.

[11] 3,943,643

[45] Mar. 16, 1976

[54] PNEUMATICALLY CLEARED TOY SLATE

[75] Inventors: John B. Fisher, Buffalo; Donald W. Scott, East Aurora, both of N.Y.

[73] Assignee: Scott-Fisher Development Company, East Aurora, N.Y.

[22] Filed: Mar. 18, 1974

[21] Appl. No.: 452,051

[52] U.S. Cl. ..... 35/66

[51] Int. Cl.[2] ..... B43L 1/12

[58] Field of Search ..... 35/61, 62, 66, 29 R; 46/44, 135 R; 222/209, 401

[56] References Cited

UNITED STATES PATENTS

| | | | |
|---|---|---|---|
| 1,264,215 | 4/1918 | Skociokh | 222/209 X |
| 1,782,328 | 11/1930 | Wearham | 40/37 X |
| 2,359,195 | 9/1944 | Berliner | 35/66 |
| 2,608,771 | 9/1952 | Sparks | 35/66 |
| 3,199,743 | 8/1965 | Berger | 222/209 X |
| 3,747,233 | 7/1973 | Berryman | 35/29 R |
| 3,863,386 | 2/1975 | Kinberg | 46/135 R |

*Primary Examiner*—Harland S. Skogquist
*Attorney, Agent, or Firm*—Oldham & Oldham Co.

[57] ABSTRACT

A toy slate of the type that has a wax coated dark slate board, a flexible milky translucent film over the slate board and a relatively impression proof transparent plastic cover layer is provided with a means for forcing a blast of air between the wax covered slate board and the translucent plastic layer thereabove to separate such layer from the slate board and clear the toy slate.

10 Claims, 8 Drawing Figures

PNEUMATICALLY CLEARED TOY SLATE

This invention relates to toy slates, and especially to a novel and improved toy slate having means therein for supplying a blast of air to the toy slate for separation of the laminations thereof when a sudden force is applied to the air blast producing means.

BACKGROUND OF THE INVENTION

Heretofore there have been many toy slates made and sold for a number of years. These toy slates comprise, as a commercial article, a lamination formed from a wax coated slate board, a milky flexible plastic film positioned over the slate board, and a relatively rigid plastic transparent top layer on the toy slate. These slates are used by some sharp or pointed instrument, such as a stylus, making a design, marks or other configurations onto the toy slate to force the translucent plastic film against the slate board to provide an image through such translucent film sheet where the force is applied by the dark slate board absorbing light rays in the impression areas. Then by merely raising the translucent sheet out of engagement with the slate board, the impression is erased. Prior patents on mechanical slate clearing means include U.S. Pat. Nos. 1,881,140; 2,404,563; and 2,359,195. Some toy slates are of modified construction by combining the transparent plastic sheet and the milky colored plastic film into one sheet.

The general object of the present invention is to provide an improved toy slate which is characterized by the provision of an air blast generation means in combination with the toy slate to create and force an air blast between the laminations of the slate to separate the image transmitting film from its slate board backing.

Another object of the invention is to provide an improved toy slate having very desirable characteristics and properties and being of greater amusement value than prior types of toy slates.

Yet another object of the invention is to provide a toy slate with an air blast generating means therein requiring application of a sudden force thereto to provide some physical activity for the user of the slate in combination with the ordinary drawing or marking actions effected upon a slate.

Other objects of the invention are to provide an improved toy slate which is of a durable construction and will provide a relatively long operative life under ordinary use conditions; to provide a toy slate of modified design having an element of surprise when the toy slate board is used and marks thereon eradicated; to provide an attractive package for a new toy slate; to provide a toy slate with an element of mystery for youngsters using the toy; and to provide a low cost toy slate having both educational and amusement values.

Reference now is particularly made to the accompanying drawings, wherein.

When referring to corresponding members shown in the drawings and referred to in the specification, corresponding numerals are used to facilitate comparison therebetween.

SUBJECT MATTER OF INVENTION

Figure 1:
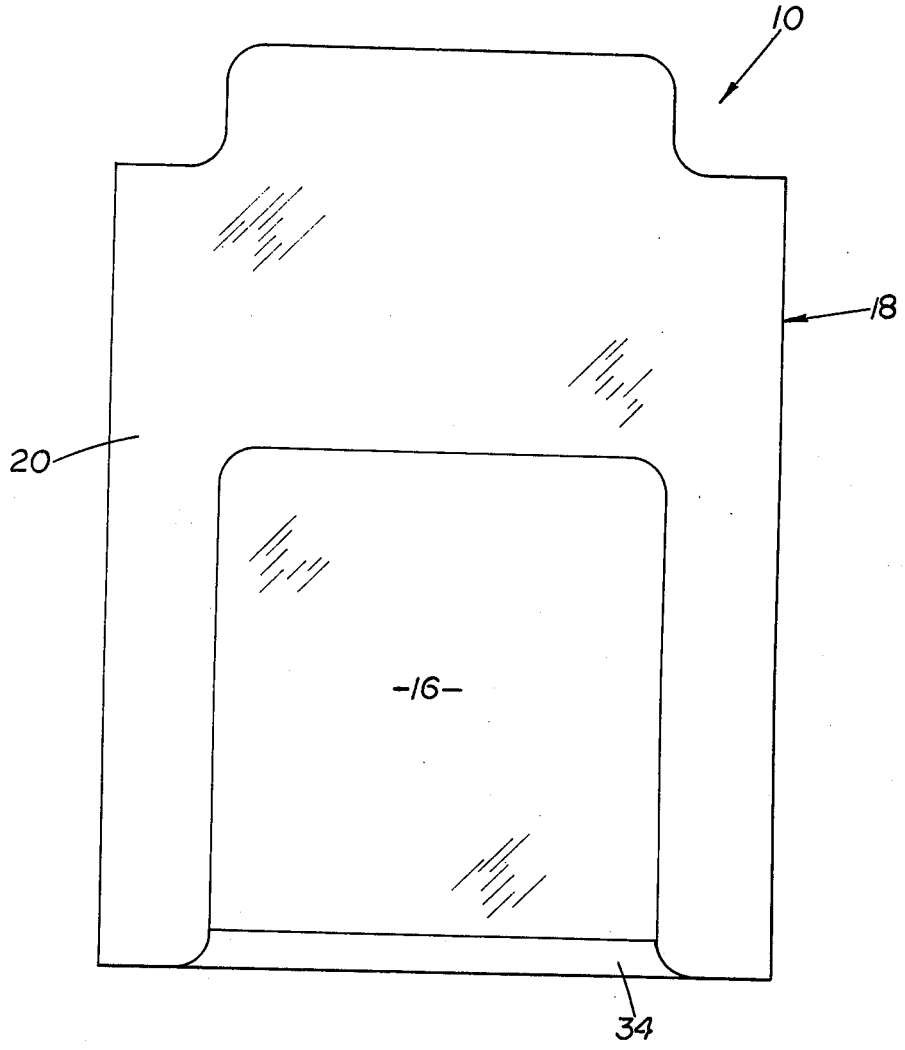
FIG. 1 is an elevation of the toy slate of the invention.

This invention, as one embodiment thereof, relates to a toy slate article including a laminated slate means comprising a base slate board, a translucent flexible plastic film sheet and a transparent plastic cover sheet, that is combined with a bellows means. The bellows means may comprise a porous foam block, and a flexible bag receiving the foam block therein, the bag having an opening at one edge and the bag or bellows usually being secured to the slate means to extend a short distance therein to one margin thereof with the bag opening between the slate board and the adjacent film sheet so that application of a sudden compressive force to the foam block forces a blast of air from the bag to flow between the slate board and the plastic film to separate the film from the slate board and erase any marking appearing on the plastic film.

Attention now is directed to the details of the structure shown in the drawing, and a toy slate is indicated as a whole by the numeral 10. This toy slate has a conventional toy slate means therein including a wax coated slate board 12, usually black, a translucent or milky, flexible plastic film sheet 14 and a transparent, relatively hard plastic cover sheet 16. The slate board usually is made by printing the desired color, as blue or black, on a chip board and then applying a transparent wax coating to the colored boards. Such slate means hence is adapted to have an impression made to show through the milky film 14 by any relatively sharp member such as a stylus, a sharpened wooden or plastic stick, etc., and such localized impression forces applied to the cover sheet 16 are transmitted to force corresponding localized areas of the film sheet 14 against the black slate board 12 and cause a black impression to show through the slate means. Such impression is erased in a conventional manner in slate means of this type by merely pulling the sheets 14 and 16 up away from the slate board 12 whereby any markings showing through the film sheet 14 are erased.

The toy slate article 10 normally includes a carrier board 18. The particular carrier board shown includes a front layer 20 and a back layer 22 preferably made from two sections **22*a* and 22*b*** that merely are folded around the rest of the article and are suitably secured together at their overlapping edges or elsewhere, as desired.

Such carrier board 18 can be made from any suitable material such as carton board or the like but if a more durable product is desired the board can be made from a sheet of wood or metal, etc., or, for a foldable cover, from a flexible plastic sheet.

An important element of the present invention relates to a bellows means that includes a spring means such as a resilient foam block 24 that is operatively associated with the slate means in a novel manner. Such foam block can be made from any suitable material such as foam polyurethane, a foamed latex rubber, etc., and the foam block has a multitude of small interconnecting cells therein whereby the block and its container in normal form include a relatively large volume of air therein which air can be expelled therefrom as a gust by any sudden compression of the foam block. The foam block, or bellows will immediately spring back to its normal shape after any conpressive force applied thereto is removed.

To aid in forming a bellows means, the foam block 24 is received in a flexible enclosure, such as a bag 26 made from a suitable plastic material, such a polyethylene, vinyl, or other relatively tough flexible plastic materials. The bag 26 has one side edge thereof open to form a mouth or opening 28 for the bag and the bag 26 is operatively secured to the slate means with the mouth or opening of the bag extending into the laminated slate means a short distance and with the bag being positioned intermediate the slate board 12 and the film sheet 14. Preferably one or more openings 30 are formed in a surface or portion of the bag 26 to facilitate the flow of air into the bag 26. Normally such opening 30 would be at about the center of the foam block 24 when the block is positioned in the bag and a corresponding opening, not shown, may be provided in an opposed portion of the bag. As the carrier board 18 in its assembled relationship with the bag 26 being positioned between the front and back layers of the carrier is relatively flexible and can have a force applied thereto without damage to such carrier board, the toy slate is so constructed so that a sudden force, as by a person's fist or hand can be applied to either the front or back surface of the carrier board when the opposed surface thereof is on a support surface to compress the foam block 24 rapidly. This causes a blast of air to exhaust from the mouth or opening 28 of the bag to be forced between the slate board 12 and the film sheet 14 and lift the film sheet out of contact with the slate board so as to erase any localized contact areas or designs as then previously appearing on the film sheet 14 and occasioned by use of the toy slate of the invention.

The drawings show that the plastic bag 26 and the slate means of the invention are secured to the carrier board as by a plurality of staples 32, or by any other equivalent or similar means including adhesives whereby the various laminates or layers of the slate means are secured together and to the carrier. Also the mouth of the bag is secured to the slate means assembly with the remainder of the bag 26 extending away from the slate means. Usually the bag is attached to the top of the slate means.

The toy slate preferably is constructed so that the edges of the slate means or laminate opposed to the plastic bag 26 are sealed together. Thus a tape 34, of any suitable conventional or commercial construction usually is applied to the base edge of the slate board 12 and it extends therearound from the back of the slate board up and over the lower edge of the film sheet and the cover sheet and with the tape engaging the cover sheet 16 to provide an air tight closure for the bottom of the slate means. Hence when a blast of air is expelled from the bag 26 it will only exhaust primarily between the side edges of the various laminates or layers forming the slate means and will produce an effective, positive separation of the film sheet 14 from any engagement with the slate board 12.

The toy slate 10 of the invention is of relatively durable construction since the slate means provided can be used repeatedly without any damage thereto, and the carrier board 18 is of a relatively durable construction so that, when any force is applied to the front or rear layer of the carrier board when the article of the invention is on a support surface or is otherwise reinforced, the desired rapid compression of the foam block and bag and the desired blast of air are produced. Even though a plurality of staples are shown securing the mouth or open edge of the bag to the slate means assembly, still streams or a volume of the air will rapidly flow between the slate board and film sheet to provide the desired eradication action. By having only one or two small openings 30 in the bag 26, the rapid compressive forces applied thereto will effectively seal or close such openings when the foam block is being compressed whereby such openings primarily provide inlet reinflation air to the foam block and bag. The openings hence do not materially reduce the compressed air blast or forces created in the bag under the compression action and the pressure on the air thus forces the air to flow as a blast or gust into the slate means assembly to extend the length thereof for marking eradication and separation of the film sheet.

It will be appreciated that any type of art work can be provided on the carrier board of the product. Thus, the art work can add to the attractive nature of the game or toy and can further suggest or aid the user in knowing that one must apply a force to the bellows portion of the article in order to achieve the desired film sheet separation action.

It should be appreciated that the cover sheet 16 be made from any suitable material, such as an acetate, and the sheet 14 is formed from a suitable flexible plastic material, such as PVC.

Figure 4:
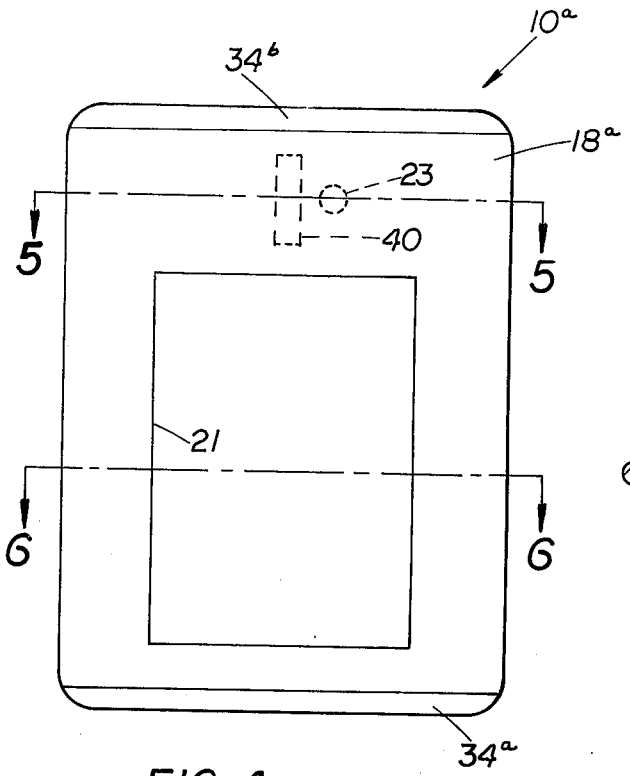
FIG. 4 is an elevation of a modified toy slate of the invention.
Figure 5:
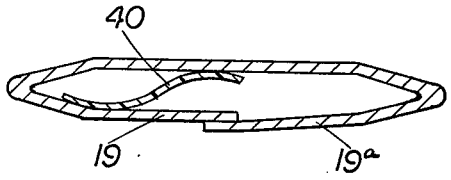
FIG. 5 is a vertical cross section taken on line 5—5 of FIG. 4.
Figure 6:
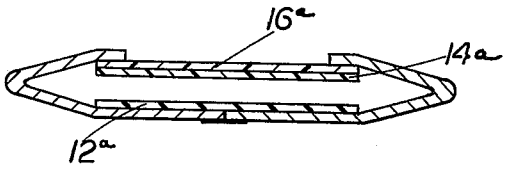
FIG. 6 is a fragmentary vertical section taken on line 6—6 of FIG. 4.

With reference to the embodiment of the invention shown in FIGS. 4 – 6, an appreciably modified bellows means is provided. FIG. 4 shows a carrier board, layer or member **18*a* which is made from cardboard or of flexible plastic and wherein the cardboard has folded over back sections 19 and 19*a* that are suitably sealed together, as by adhesive means, at their overlapping edges. Also, the top and bottom edges of the carrier 18*a* have sealing strips 34*a* and 34*b*** suitably secured to the edges of the folded carrier board to form an enclosure thereith by extending over and being secured to the top surface of the top layer of the carrier board and extending around the edges and being secured to the lower surface of the carrier board and being sealed thereto along the complete length of the top and bottom edges.

In this toy slate **10*a*, the slate board 12*a* is suitably secured usually around its entire periphery, to the back carrier sections 19 and 19*a* to be carried thereby, while the transparent plastic top sheet 16*a* and the intermediate milky plastic sheet 14*a* are usually suitably sealed to each other around their edges. Such sheets also are secured around their peripheries as by glue or other adhesive to the carrier board 18*a* at an opening 21 formed therein for exposing the toy slate means themselves, as indicated in FIG. 1. Hence the carrier board or sheet 18*a* forms an airtight enclosure with the slate means. An air inlet hole 23 or more is provided in the carrier board 18*a***.

The bellows action as desired in the invention is aided in this instance by any suitable type of a resilient expansion member such as a foam block or a leaf spring 40 that is secured to the front or back of the carrier board and resiliently engages the opposed portion of the carrier board to spring the top and back portions of the carrier board apart when no compressive force is applied thereto. By securing the slate board 12*a* to the back of the carrier board and the other two portions of the toy slate to the front portion of the carrier board, it hence is possible to push areas of the flim sheet 14*a* down against the slate board by a stylus or other member so as to use the top slate in the usual manner. However, an air blast can be provided by merely applying a sudden compressive force to the upper portion of the toy slate article at the spring 40 and this forces an air blast to flow between the adjacent sheet 14*a* and the carrier board 12*a* for the desired separation action therebetween to erase any marks or figures then appearing on the toy slate.

Figure 7:
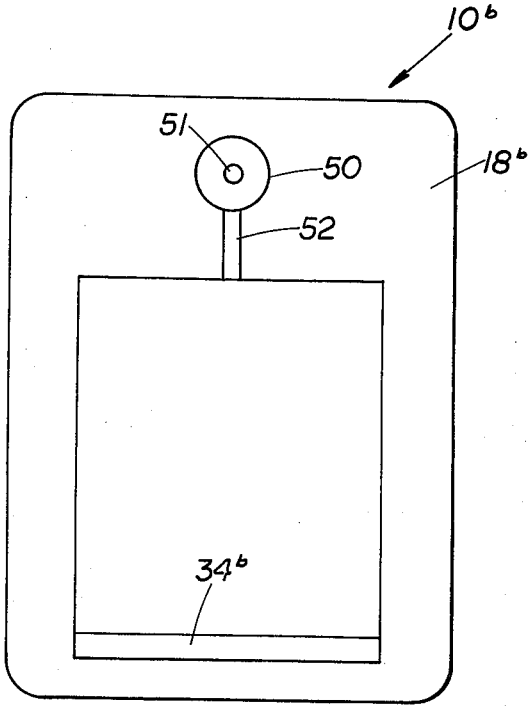
FIG. 7 is an elevation of a further modification of the toy slate of the invention.
Figure 8:
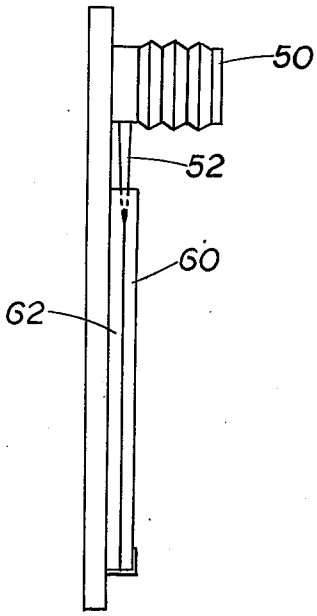
FIG. 8 is a side elevation of the toy slate of FIG. 7.

Yet a further modification of the invention is shown in a toy slate 10*b* of FIGS. 7 and 8. In this instance, normally a rigid carrier board 18*b* is provided and any suitable conventional bellows 50 is suitably secured to the carrier board and it has an exhaust tube 52, usually formed from a flexible plastic or rubber member, connecting to the exhaust opening of the bellows 50. An air inlet opening 51 is provided at the top or bottom of the bellows 50. Thus when the bellow is compressed suddenly an airblast will flow out of the exhaust tube 52.

Figure 2:
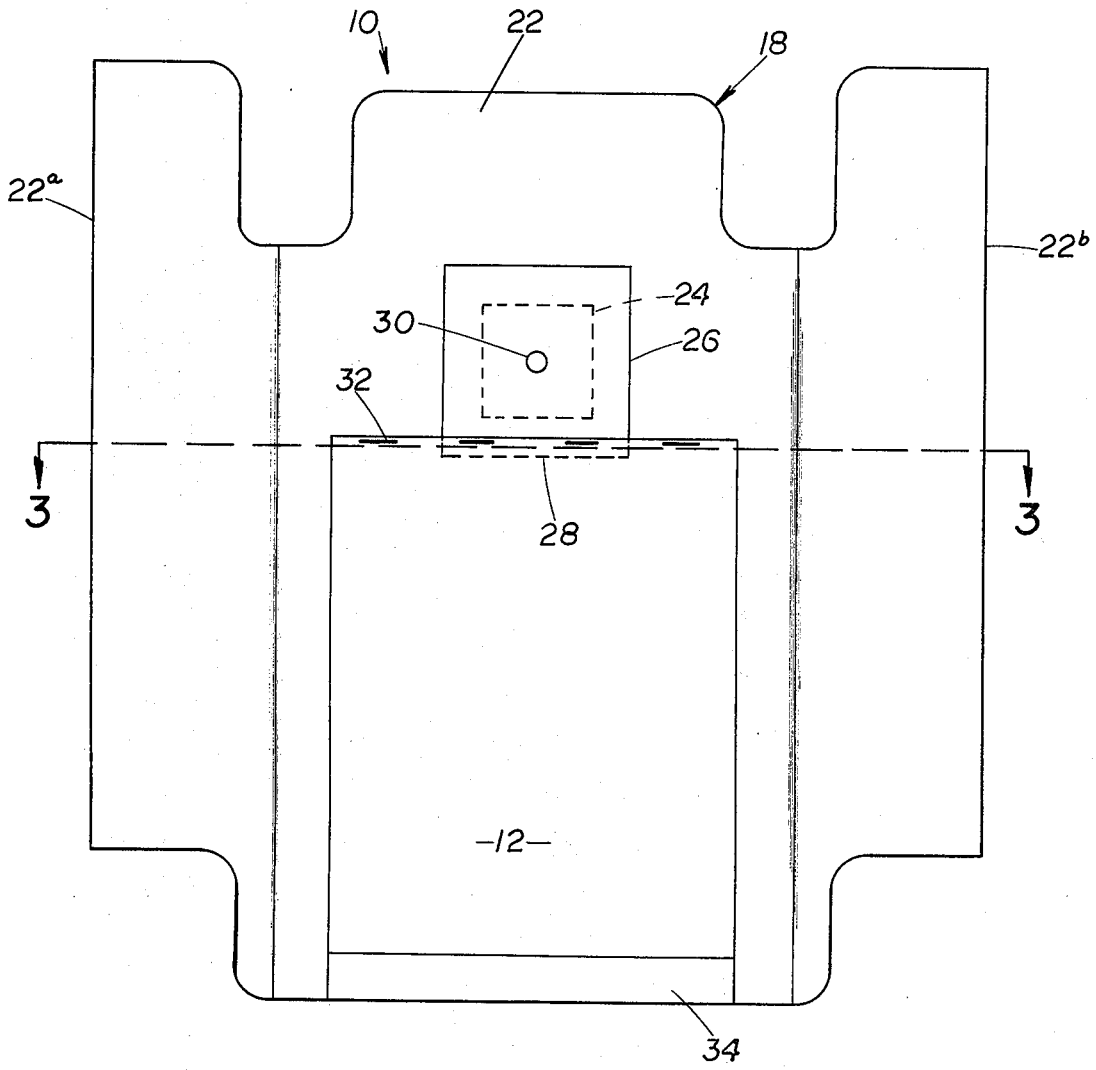
FIG. 2 is a rear elevation of the toy slate article of FIG. 1 with the carrier board for the article being opened to show the interior components of the article.
Figure 3:
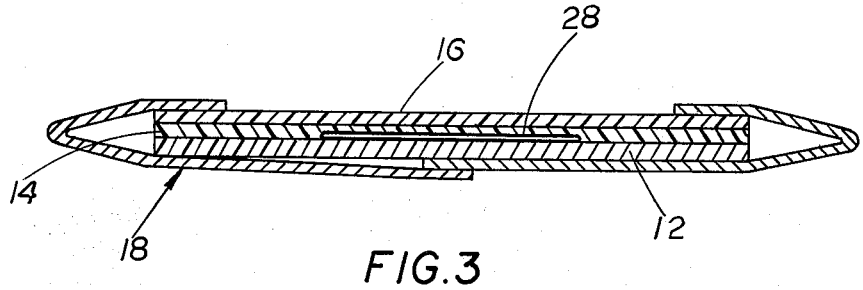
FIG. 3 is an enlarged fragmentary section taken on line 3—3 of FIG. 2.

A slightly different type of slate means is shown in association with the bellows 50 although a substantially conventional toy slate as shown in FIGS. 1 – 3 may be used with the bellows if desired. However, in this embodiment, a wax coated, dark slate board 62 of known construction is provided. A cover sheet 60 that usually is slightly more flexible than the slate cover sheet 16 of FIGS. 1 – 3 is positioned over the slate board 62. The sheet 60 may be made from an acetate material or a similar plastic and it would be transparent and somewhat rigid. However, the cover sheet 60 has a milky or translucent coating or layer applied to its under surface. This is a known modified type of toy slate in which impressions or marks appear when a stylus makes localized markings or designs on the cover sheet 60 to force it against the dark, wax coated slate board 62 to permit light rays to pass through the sheet 60 and be absorbed by the sheet 62. Usually an end sealing tape 34*b* is provided at the lower ends of these laminated sheets 60 and 62. The exhaust tube 52 connects to the slate means between the layers or sheets 60 and 62.

In view of the foregoing, it is seen that the airblast producing means used in the toy slate article of the invention can be modified appreciably and that the design of the entire article can be altered without departing from the inventive principle of the invention.

A toy hammer means might be provided with the slate to use in striking or compressing the bellows means rapidly.

Yet another possible modification of the toy of the invention would be to incorporate a conventional squeaker device in the wall of the bellows or in the bag 26 in a side portion thereof. Thus, when the bag and plastic foam block 24 are compressed, a small amount of air could blast out through the squeaker, as well as through the mouth or opening of the bag connected to the slate board means so that a further attractive feature would be present in the toy slate and in use thereof, or the squeaker could make a sound when air flows back through it into the bag or bellows.

It may be desirable, in the toy slate article of FIGS. 4 to 6, to staple the sheets or layers 12*a*, 14*a* and 16*a* together at their upper margins to prevent premature erasure action. The air blast produced for erasure would still act to separate the milky plastic sheet 14*a* from pressure contact with the slate board 12*a*.

The bellows means, of course, may be positioned at the side of the laminated slate means rather than at the top as shown.

FIG. 2 shows the portions 22*a* and 22*b* extending slightly upwardly rather than being flattened.

Another advantage of the invention is that it provides a durable toy slate as a user cannot pull on or reach the edges of the sheets 14 and 16 to tear or damage such sheets.

The toy slate article of the invention consequently not only provides educational and amusement value to a user, but provides one with some physical exertion and some additional interest in the use of a toy slate board. Hence, it is believed that the objects of the invention have been achieved.

While several complete embodiments of the invention have been disclosed herein, it will be appreciated that modification of such embodiments of the invention may be resorted to without departing from the scope of the invention.

What is claimed is:

1. A toy slate comprising a laminated slate means including a slate board, and a transparent plastic cover sheet having a translucent milky layer thereunder; and a bellows means operatively connected to the slate means between the slate board and the adjacent layer so that a sudden compressive force applied to the bellows means forces a blast of air to flow between the slate board and the layer to separate the layer from the slate board and erase any marking appearing on the slate means.

2. A toy slate as in claim 1 where the bellows means comprise a resilient block member and a flexible bag receiving the block and having an exhaust opening connecting to the slate means.

3. A toy slate article as in claim 1 where the bellows means comprise a carrier board that includes front and back layers, and a spring means positioned between such front and back layers to urge them apart, the slate means and the carrier board forming an air tight enclosure.

4. A toy slate article as in claim 1 wherein the bellows means comprise a resilient member and an enclosure therefor.

5. A toy slate as in claim 1 where the bellows means comprise a bellows, and an exhaust tube for the bellows connected to the slate means.

6. A toy slate article as in claim 1 where a carrier board is provided and includes front and back layers, and the bellows means is positioned between such front and back layers.

7. A toy slate as in claim 1 where a carrier board including front and back layers is provided, said bellows means is positioned between said front and back layers, and one of said layers has an air supply aperture therethrough adjacent said bellows means.

8. A toy slate as in claim 7 where said slate means includes a flexible milky colored sheet between said plastic cover sheet and said slate board, said milky colored sheet forming said milky layer, and any air blast provided flows between said slate board and said flexible milky colored sheet.

9. A toy slate comprising a carrier board;

a slate means including a wax coated paper slate board, a translucent flexible plastic film layer extending over the slate board, and a transparent relatively hard plastic cover sheet covering the plastic film layer secured to the carrier board;

a porous resilient foam block; and a flexible bag receiving the foam block therein, the bag including a mouth opening, which bag is secured to the slate means and extends a short distance thereinto from one margin thereof with the mouth opening being between the slate board and the adjacent film layer.

10. A toy slate as in claim 9 and including means sealing the margins of the slate board and plastic film layer opposite the bag together whereby a sudden compressive force applied to the foam block forces a blast of air from the bag to flow between the slate board and the plastic film to separate the film from the slate board and erase any marking appearing on the plastic film.

* * * * *